United States Patent [19]

Mlynarz

[11] Patent Number: 4,992,691

[45] Date of Patent: Feb. 12, 1991

[54] SLIP RING ARRANGEMENTS

[75] Inventor: Richard Mlynarz, Cormeills En Parisis, France

[73] Assignee: General Motors France, France

[21] Appl. No.: 435,864

[22] Filed: Nov. 3, 1989

[51] Int. Cl.[5] ..... H01R 39/08

[52] U.S. Cl. ..... 310/232; 310/45; 310/143; 310/237

[58] Field of Search ..... 310/232, 219, 231, 233, 310/234, 235, 236, 237, 238, 136, 143, 148, 45, 43, 90

[56] References Cited

U.S. PATENT DOCUMENTS

| | | | |
|---|---|---|---|
| 1,901,955 | 3/1933 | Giamo | 310/237 |
| 2,782,329 | 2/1957 | Kirby et al. | 310/231 |
| 3,504,141 | 3/1970 | Webster | 200/25 |
| 3,842,301 | 10/1974 | Smith | 310/232 |
| 3,870,914 | 3/1975 | Walker | 310/219 |
| 3,963,291 | 6/1976 | Maloof | 339/8 P |
| 4,433,263 | 2/1984 | Longhouse et al. | 310/237 |
| 4,453,102 | 6/1984 | Sawabe et al. | 310/237 |

FOREIGN PATENT DOCUMENTS

| | | | |
|---|---|---|---|
| 0088670 | 2/1983 | European Pat. Off. . | |
| 2425578 | 1/1975 | Fed. Rep. of Germany | 310/232 |
| 2412184 | 8/1979 | France | 310/237 |
| 0738823 | 10/1955 | United Kingdom | 310/235 |

*Primary Examiner*—R. Skudy

*Attorney, Agent, or Firm*—C. R. Meland

[57] ABSTRACT

A slip ring arrangement for feeding electrical current to, or receiving electrical current from, coil windings which are mounted on a rotatable shaft for rotation therewith, the slip ring arrangement comprising a first slip ring of electrically conducting material which is substantially cylindrical and which is mounted on the rotatable shaft, adjacent one end of the rotatable shaft, for rotation therewith; and a second slip ring of electrically conducting material which is electrically isolated from the first slip ring, which is substantially flat, and which is mounted on the said one end of the rotatable shaft for rotation therewith. Suitable for use with alternators. Allows reduction in length of slip ring arrangement and rotatable shaft. The second slip ring reduces wear on its contacting brush.

3 Claims, 2 Drawing Sheets

SLIP RING ARRANGEMENTS

This invention relates to slip ring arrangements for feeding electrical current to, or receiving electrical current from, coil windings on a rotatable shaft, and in particular, a slip ring arrangement for an alternator.

An alternator conventionally comprises a stator assembly including a stator core of soft iron and stator windings; a rotor assembly including a rotor (rotatable) shaft with a rotor coil winding mounted thereon; a pair of slip rings mounted on the rotor shaft; and brushes for making electric connection with the slip rings. The slip rings are isolated from one another and electrically connected to each end of the rotor coil winding. Current is fed to the slip rings through the brushes to produce a magnetic field in the rotor coil winding. As this rotates within the stator assembly, an alternating current is generated in the stator windings. It is conventional practice for both the slip rings to be substantially cylindrical (as shown in FIG. 1).

It is an object of the present invention to provide an improvement to the above mentioned slip ring arrangement.

A slip ring arrangement in accordance with the present invention comprises a first slip ring of electrically conducting material which is substantially cylindrical and which is mounted on the rotatable shaft, adjacent one end of the rotatable shaft, for rotation therewith; and a second slip ring of electrically conducting material which is electrically isolated from the first slip ring, which is substantially flat, and which is mounted on the said one end of the rotatable shaft for rotation therewith.

The present invention has the advantage that the slip ring arrangement can be reduced in length, allowing a reduction in length of the rotatable shaft. In an alternator, this can result in usage of less material, reduction in weight, a more efficient alternator, and a reduction in cost. Further, where one brush tends to wear more rapidly than the other on conventional arrangements (due to the different polarities of the brushes), in the present invention the normally faster wearing brush can be used with the flat slip ring which has been found to produce less wear on the brushes. A more even wear of the brushes therefore results when using the present invention.

Preferably, the second slip ring is a substantially flat circular disc. Alternatively, the slip ring may be a substantially flat annular ring. In the latter case, a portion of the said one end of the rotatable shaft may extend through the center of the second slip ring. In either case, the second slip ring preferably has an integral cylindrical rim at its circumferential edge.

The rotatable shaft is preferably of electrically conducting material, in which case the first and second slip rings are preferably mounted on an insulator of electrically insulating material which is secured to the rotatable shaft to electrically isolate the first and second slip rings from one another and from the rotatable shaft. Alternatively, the rotatable shaft may be of electrically insulating material, in which case the first and second slip rings may be mounted directly on the rotatable shaft. In either case, the first and/or second ring may be secured to the electrically insulating material by resilient teeth which are integral with the slip ring and which bite into the electrically insulating material. Alternatively, the first and/or second slip ring may be secured to the electrically insulating material by adhesive.

Preferably, the first and second slip rings are of copper.

The present invention also includes an alternator incorporating a slip ring arrangement in accordance with the present invention.

The present invention will now be described by way of example, with reference to the accompanying drawings, in which.

Figure 1:
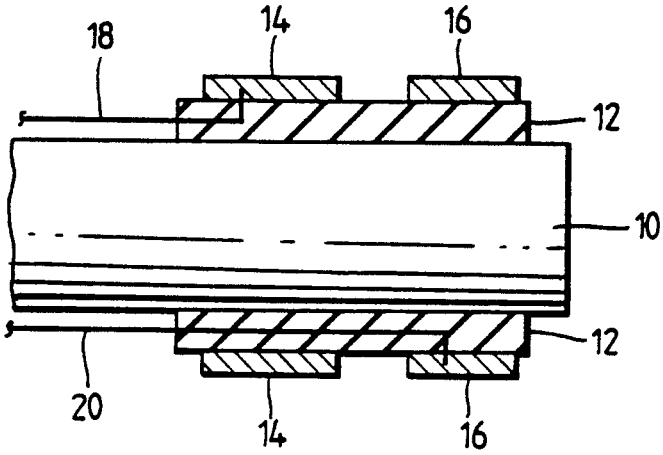
Fig. 1. PRIOR ART
FIG. 1 is a cross-sectional view of a conventional slip ring arrangement for an alternator.

The conventional slip ring arrangement shown in FIG. 1 comprises a rotor (rotatable) shaft 10, an insulator 12 of electrically insulating material secured to the rotor shaft, a pair of copper slip rings 14, 16 which are substantially cylindrical and secured to the insulator, and a pair of electrical conductors 18, 20 for connecting each slip ring to an end of the rotor coil winding (not shown).

Figure 2:
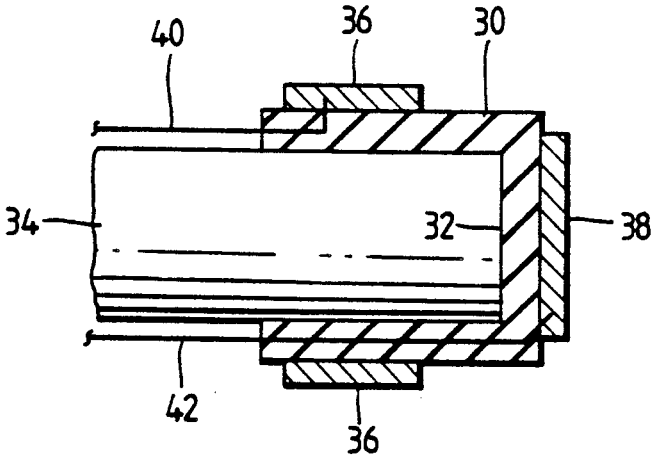
FIG. 2 is a cross-sectional view of a first embodiment of a slip ring arrangement in accordance with the present invention.

The slip ring arrangement shown in FIG. 2 is in accordance with a first embodiment of the present invention, and :s also for use with an alternator. In this slip ring arrangement an insulator 30 of electrically insulating material is secured around an end 32 of a rotor (rotatable) shaft 34 which is metallic. A first slip ring 36 of copper is secured to the insulator 30 by adhesive adjacent the end 32 of the rotor shaft 34, the first slip ring being substantially cylindrical as in a conventional arrangement. A second slip ring 38 of copper is secured to the insulator 30 by adhesive at the end 32 of the rotor shaft 34. The second slip ring 38 is a substantially flat circular disc. The insulator 30 electrically isolates the slip rings 36,38 from one another, and from the rotor shaft 34. A pair of conductors 40, 42 connect each slip ring 36, 38 to an end of the rotor coil winding (not shown). As can be seen in comparison to FIG. 1, the slip ring arrangement is reduced in length.

A similar arrangement to that shown in FIG. 2 is also shown in FIGS. 3, 4, 5 and 6, and like parts have been given the same reference numbers.

Figure 3:
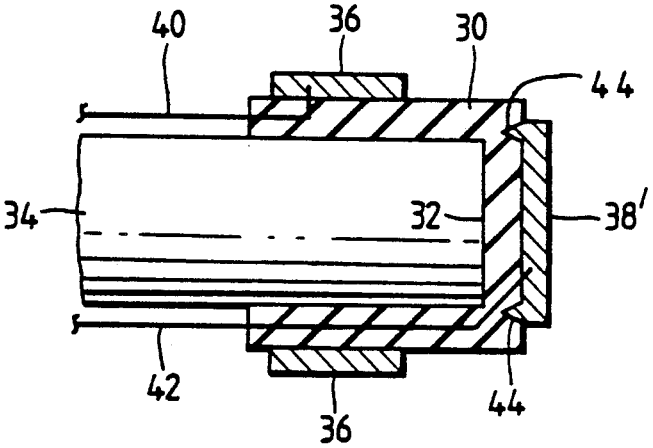
FIGS. 3 to 6 are cross-sectional views of alternative embodiments of slip ring arrangements in accordance with the present invention.

In the arrangement shown in FIG. 3, the second slip ring 38' has integral resilient teeth 44 which bite into the insulator 30 to secure the second slip ring thereto.

Figure 4:
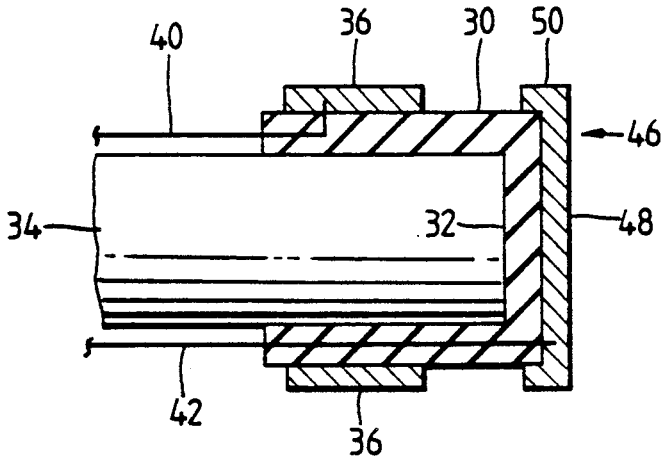
Figure 5:
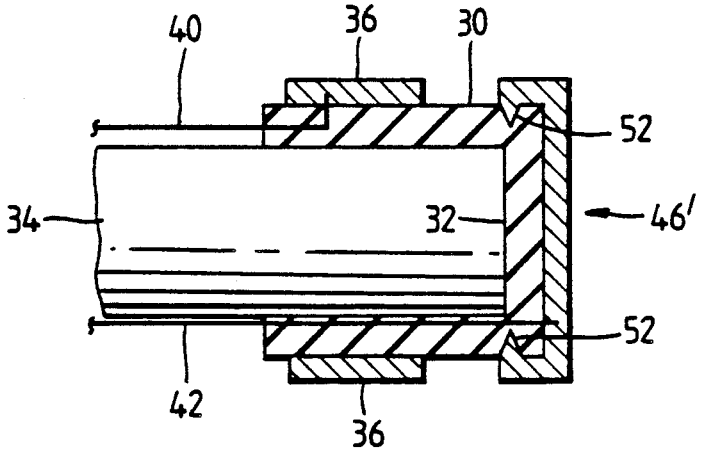

In FIG. 4, the second slip ring 46, is in the form of a substantially flat circular disc 48 having an integral cylindrical rim 50 at its outer circumferential edge. In this case, the second slip ring 46 is secured by adhesive to the insulator 30. In the similar arrangement shown in FIG. 5, the second slip ring 46' is secured to insulator 30 by integral resilient teeth 52 that bite into insulator 30.

Figure 6:
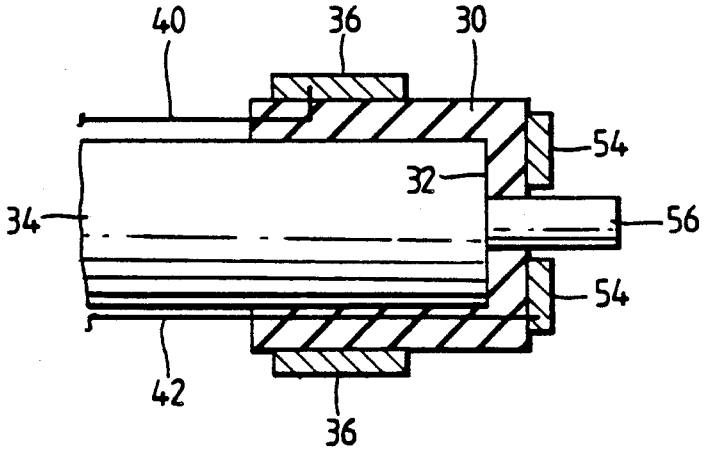

The slip ring arrangement shown in FIG. 6 comprises a second slip ring 54 which is in the form of a substantially flat annular ring, and which is secured to the insulator 30 by adhesive. In this case, a portion 56 of the end 32 of the rotor shaft 34 extends through the center of the second slip ring 54 to allow the end of the rotor shaft to be supported by a bearing (not shown) if required.

The embodiments of the invention in which an exclusive property or privilege is claimed are defined as follows:

1. A slip ring assembly for supplying current to a rotor coil winding of an alternating current generator comprising, a metallic rotatable rotor shaft, an electrical insulator secured to said shaft for rotation therewith, said electrical insulator having a first portion surrounding an axially extending portion of said shaft and having an integral second portion extending entirely across an end of said shaft, said first portion of said insulator having a cylindrical outer surface, said second portion of said insulator having an outer flat surface that is substantially normal to a longitudinal axis of said shaft, a first cylindrical slip ring of electrically conducting material secured to and engaging said cylindrical outer surface of said insulator and a second flat slip ring of electrically conducting material secured to and engaging said flat surface of said insulator, said second flat slip ring entirely covering a center portion of said flat surface of said insulator.

2. The slip ring assembly according to claim 1 wherein said second flat slip ring is a substantially flat circular disc of electrically conducting material.

3. A slip ring assembly for supplying current to a rotor coil winding of an alternating current generator comprising, a metallic rotatable rotor shaft, said shaft having a first axially extending cylindrical portion and a second cylindrical portion that extends axially of said first portion, said second cylindrical portion having a diameter that is less than the diameter of said first axially extending cylindrical portion to thereby define an annular surface that is normal to a longitudinal axis of said shaft, said second cylindrical portion of said shaft being adapted to be rotatably support by a bearing, an electrical insulator secured to said shaft for rotation therewith, said electrical insulator having a first portion surrounding said first axially extending cylindrical portion of said shaft, said electrical insulator having a second portion that is integral with said first portion of said insulator, said second portion of said insulator engaging said annular surface of said shaft and extending normal to the longitudinal axis of said shaft, said second portion of said insulator having a central opening, a first cylindrical slip ring of electrically conducting material secured to and engaging an outer surface of said first portion of said insulator and a second flat annular ring-shaped slip ring of electrically conducting material secured to and engaging an annular end surface of said second portion of said insulator, said second cylindrical portion of said shaft extending through said central opening in said second portion of said insulator and through said second flat annular ring-shaped slip ring.

* * * * *